United States Patent [19]

Gailey et al.

[11] 4,382,354

[45] May 10, 1983

[54] SIDING PANEL SYSTEMS WITH PANEL-MOUNTING DEVICES

[75] Inventors: J. Lynn Gailey, Newton Falls; Carl A. Wollam, Cortland, both of Ohio

[73] Assignee: Alcan Aluminum Corporation, Cleveland, Ohio

[21] Appl. No.: 258,279

[22] Filed: Apr. 28, 1981

[51] Int. Cl.[3] ..... E04D 1/34; E04D 3/362

[52] U.S. Cl. ..... 52/521; 52/127.1; 52/545; 52/748

[58] Field of Search ..... 52/127.1, 127.2, 514, 52/520, 521, 531, 545, 748

[56] References Cited

U.S. PATENT DOCUMENTS

| | | | |
|---|---|---|---|
| 3,325,952 | 6/1967 | Trachtenberg | 52/514 X |
| 3,347,009 | 10/1967 | Meddick | 52/545 |
| 3,757,483 | 9/1973 | Torbett | 52/545 X |
| 3,903,670 | 9/1975 | Robinson | 52/545 X |
| 3,945,166 | 3/1976 | Hosoda et al. | 52/545 X |
| 4,187,661 | 2/1980 | Poiry | 52/748 |
| 4,288,958 | 9/1981 | Chalmers et al. | 52/520 X |
| 4,356,673 | 11/1982 | Gailey | 52/127.1 |

*Primary Examiner*—J. Karl Bell

*Attorney, Agent, or Firm*—Cooper, Dunham, Clark, Griffin & Moran

[57] ABSTRACT

For use with horizontal siding panels each having complementary first and second locking means respectively formed along their top and bottom margins for interlocking vertically adjacent courses of panels in overlapping array, a system for mounting, on a wall, a panel interposed between already-mounted upper and lower courses which are vertically spaced by a distance less than the height of the interposed panel. The system includes clip means for securing the second locking means of the upper-course panels to the wall while permitting upward insertion of the first locking means of the interposed panel, behind the upper-course panels, to a level above that at which the second locking means of the upper-course panels would interlock therewith, retaining means for securing the first locking means of the interposed panel to the wall at that level against upward, downward or outward movement, and means mountable on the top margins of the lower-course panels for interlocking with the second locking means of the interposed panels, the interlocking means, when thus mounted, being vertically slidable through a range of elevations relative to the lower-course panels.

8 Claims, 6 Drawing Figures

Fig. 1.
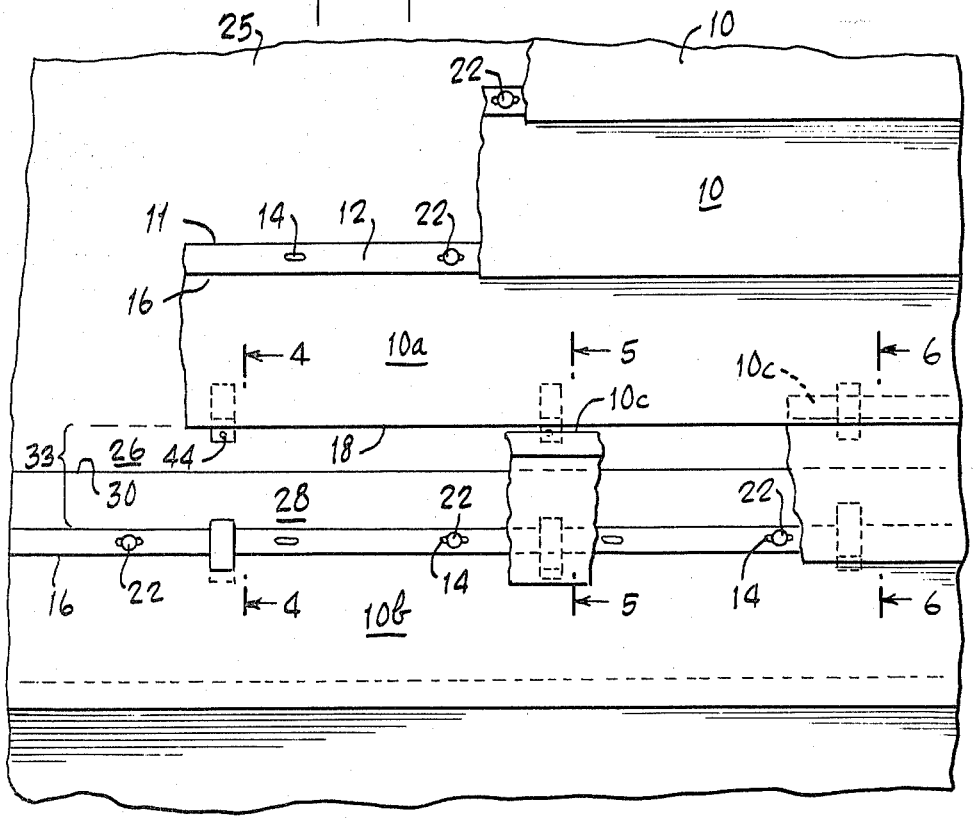
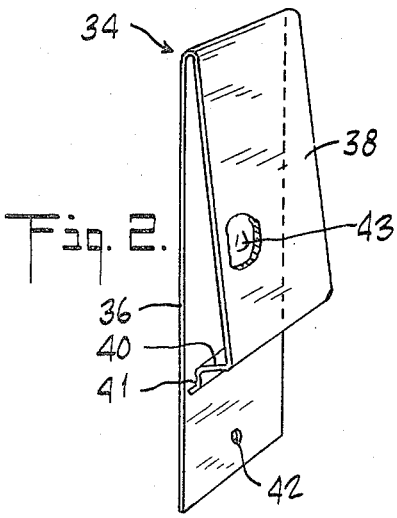
Fig. 2.
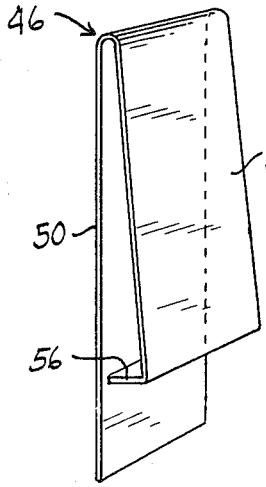
Fig. 3.

SIDING PANEL SYSTEMS WITH PANEL-MOUNTING DEVICES

BACKGROUND OF THE INVENTION

This invention relates to siding panel systems and devices for installing them on a wall or the like and more particularly to devices for mounting a horizontal siding panel between and in lapped relation to vertically spaced upper and lower courses of such panels already mounted on a wall. In an important specific aspect, the invention is directed to devices for mounting a horizontal siding panel at the joint between upper and lower panel-clad prefabricated wall sections.

Horizontally elongated siding panels made of roll-formed sheet metal or molded plastic are widely employed for cladding exterior building walls. Typically, they are mounted in parallel, overlapping, interlocked relation on a wall with their surfaces sloping downwardly and outwardly to simulate the appearance of wooden clapboards or rows of shingles. Each panel is attached at its top margin to the wall by suitable fasteners, such as nails driven through a flat nailing flange portion of the panel top margin. A first locking means (e.g. an outwardly projecting lip) is formed on each panel adjacent the top margin and below the nailing flange; a second locking means (e.g. an inwardly projecting, upwardly opening channel flange), formed at the bottom margin of each panel, overlies and interlocks with the first locking means or lip of the next lower panel on the wall to secure the panel bottom margin to the wall and to conceal the fasteners that hold the lower panel.

In conventional installation of such panels, the bottom flanges of the panels of the lowermost course to be installed on a wall are first interlocked with a starter strip previously mounted along the lower edge of the wall, and the top margins of these lowermost panels are nailed to the wall. The bottom flanges of the panels of the second (next higher) course are then interlocked with the lips of the panels of the lowest course, and the top margins of the second-course panels are nailed to the wall. Thereafter, progressively higher courses of the panels are installed in succession in like manner one above another, until the wall is fully clad with a continuous array of the panels, each held along its top margin by nails and along its bottom margin by interlocking engagement with the adjacent lower course of panels so as to be fully secured against dislodgement.

It would sometimes be desirable to interpose a panel or a course of panels in a gap or space between previously installed upper and lower courses, i.e. at a location which is below as well as above already-mounted courses of panels. Unless the already mounted upper and lower courses are precisely spaced a proper distance apart, however, it is not possible to interlock both the first and second locking means of the interposed panel with the second locking means of the upper panel and the first locking means of the lower panel, respectively, because the tolerances for such spacing (to achieve the requisite interlocking at both the top and bottom of the interposed panel) are very small. Attainment of requisitely precise spacing is extremely difficult. In addition, since for proper overlapping and interlocking the top margin of the interposed panel must be inserted behind the bottom margin of the already-mounted upper panel, it is in general virtually impossible to fasten the top margin of the interposed panel to the wall, as necessary to secure both the interposed panel and the bottom margin of the upper panel. Consequently, the secure and stable installation of a panel interposed between vertically spaced courses of already-mounted panels has heretofore presented serious problems.

One commercially important situation in which the foregoing problems arise is in the use of siding panels on prefabricated buildings, wherein exterior walls (e.g. frame walls constituted of wooden studs, and having sheathing, doors, windows, etc.) as well as other components are produced in a more or less finished condition by a manufacturer and transported to a construction site for assembly. Since it is frequently difficult or impossible to transport a building wall (especially a wall more than one story high) as a single integral unit, prefabricated exterior walls are commonly made in two or more sections which are assembled one above another at the construction site. Installation of siding panels on prefabricated walls by the manufacturer is often considered desirable, to reduce labor costs in the field, to control the amount of siding used, and to expedite final assembly of the building; but in the case of walls prefabricated in upper and lower sections having siding panels installed by the manufacturer, there is a discontinuity on the assembled wall between the arrays of panels respectively mounted on the upper and lower wall sections.

That is to say, it is not feasible to dispose the top course of panels on the lower wall section and the bottom course of panels on the upper wall section so that they will interlock properly, or to effect such interlocking when the sections are assembled. Ordinarily, then, it is necessary to leave a gap (i.e. at the juncture of the wall sections) between the upper and lower panel arrays; and indeed, since the height of the lower wall section is usually not equal to the height of an integral number of courses of siding panels, such a gap is practically unavoidable. In such instances, it would be extremely difficult to so locate a bottom course of panels on the upper wall section that the height of this gap will equal the height of one course of panels, within proper dimensional tolerances for conventionally interlocking a course of panels between the upper and lower arrays. Moreover, even if the panels could be so disposed, it would not be feasible to properly secure the top margin of the course of panels thus interposed between the arrays.

For these reasons, in assembling upper and lower prefabricated wall sections having pre-installed siding panels, resort has conventionally been had to makeshift expedients such as the use of wooden trim boards to bridge the gap between the arrays of siding on the respective sections. These expedients are unsatisfactory both from the standpoint of appearance and because they detract from the protection and durability afforded by a continuous interlocked array of siding panels of the described type.

The copending U.S. patent application of J. Lynn Gailey (one of the applicants herein), Ser. No. 177,358, filed Aug. 11, 1980, now U.S. Pat. No. 4,356,673, for Siding Panel Systems and Methods of Installation, and assigned to the same assignee as the present application, describes systems and methods for mounting a course of siding panels (having the aforementioned first and second locking means) between and in lapped relation to vertically spaced upper and lower courses of similar panels pre-installed on a wall, such that each course of the panels is attached along both the top and the bottom margins with security comparable to that of wholly conventionally installed panels, and the finally assembled courses of panels present the appearance of a continuous overlapping panel array. An illustrative example of use of the systems and methods described in the application is in the joining of arrays of panels respectively pre-installed on upper and lower prefabricated wall sections, i.e. to cover the joint between the sections.

For the practice of the systems and methods of the copending application, it is essential that the height (vertical extent) of the gap between the upper and lower courses of pre-installed panels be less than the panel height of the course of panels that is to be interposed between them. A suitable gap height is relatively easy to achieve, since these systems and methods do not require the close dimensional tolerances that would be necessary if the panels were to be interlocked in conventional manner, but accommodate a substantial range of gap heights for any given panel height. It will be understood that the term "panel height" as used herein refers to the vertical distance between the first and second locking means of a panel, while the term "gap" refers to the distance between the second locking means of the upper course and the first locking means of the lower course of panels; also, that the term "course of panels" embraces one panel or plural panels at a common elevation. For convenience, the course of panels to be installed between the upper and lower courses mentioned above will be referred to herein as the interposed panel course.

In a broad sense, the system of the aforementioned copending application includes the combination of clip means fixedly mountable on a wall for interlocking with the second locking means of a panel of the upper course to secure the bottom margin of the upper-course panel to the wall, and retaining means securable to the wall and having a portion for engaging the first locking means of a panel of the interposed course, at a location behind the upper-course panel and above the elevation at which the first locking means of the interposed panel would conventionally interlock with the second locking means of the upper course panel, to hold the first locking means of the interposed panel against downward movement below the aforementioned location and to secure the top margin of the interposed panel fixedly to the wall, with both the clip means and the retaining means concealed behind the upper-course and interposed panels, the clip means being shaped and dimensioned to accommodate insertion of the top margin of the interposed panel upwardly behind the bottom margin of the upper-course panel (i.e. after the clip means is mounted on the wall and the upper-course panel is interlocked therewith) at least to an extent sufficient to position the first locking means of the interposed panel at the aforementioned location.

It will be understood that, given the gap height defined above between the upper and lower courses, the aforementioned location can be so chosen that when the first locking means of the interposed panel is at that location, the bottom margin of the interposed panel (with the second locking means thereof) overlaps the top margin and first locking means of the lower course of panels. A complete panel assembly incorporating the described system of the aforementioned copending application also includes means for interlocking with the second locking means of the interposed panel to secure the bottom margin of the interposed panel to the wall in such overlapping relation to the lower-course panels, the interlocking means being concealed behind the interposed panel.

The method of the aforementioned copending application, for mounting an interposed panel between upper and lower courses as described above, thus broadly includes the steps of inserting the top margin of the interposed panel upwardly behind the bottom margin of the already-installed upper panel course until the first locking means of the interposed panel reaches a predetermined elevation higher than that at which it would interlock with the second locking means of the upper course of panels, fixedly securing the interposed panel to the wall at that elevation by engagement of the first locking means thereof with a retainer structure fixedly mounted on the wall, and securing the bottom margin of the interposed panel to the wall (in overlapping relation to the top margin of the lower course of panels) by engagement of its second locking means with an interlocking structure also mounted on the wall. In this way, the gap between the upper and lower courses is bridged by a panel to provide a continuous array of panels each secured to the wall along both top and bottom margins, yet in a manner that avoids the need for high precision in relative positioning of the upper and lower courses.

In the specific embodiments described in the aforementioned copending application, the interlocking means is the first locking means of a panel of the lower course, the retaining means further includes means for positioning its engaging portion at a height (above the first locking means of the lower course panel) equal to the panel height of the interposed panel course; the retaining means and the interlocking means cooperatively prevent upward and downward movement of the interposed panel after installation. The clip means in these specific embodiments comprises a first set of spring clips which (in the case of prefabricated building construction) are mounted on the upper wall section by the manufacturer of the wall sections, while the retaining means comprises a second set of spring clips which (in such case) are positioned and nailed to the wall at the building site by the assembler of the building.

SUMMARY OF THE INVENTION

The present invention contemplates the provision of panel systems and mounting devices of the general type described in the aforementioned copending application, for mounting an interposed course of panels between spaced upper and lower courses of panels (e.g. to cover the joint between upper and lower prefabricated wall sections), and including clip means, retaining means and interlocking means all as broadly defined above, but (as compared with the specific embodiments of devices disclosed in the copending application) incorporating novel structural features affording significant advantages particularly with respect to ease and simplicity of panel installation.

In accordance with the invention, the retaining means comprises means for positively restraining the first locking means of the interposed panel against upward movement above the aforementioned location (i.e. the location at which the first locking means is disposed when the interposed panel is in its final, mounted position) as well as for holding the first locking means against downward movement and fixedly securing the top margin of the interposed panel to the wall. Further, the interlocking means comprises means, mountable on the top margin of a panel of the lower course so as to be selectively positionable throughout a range of elevations relative thereto, for interlocking with the second locking means of the interposed panel outwardly of the lower-course panel at a level below that at which the second locking means of the interposed panel would interlock with the first locking means of the lower-course panel.

Advantageously, the interlocking means of the invention comprises at least one spring clip member having an inner depending leg insertable between the top margin of the lower-course panel and the wall for holding the clip member against outward movement while permitting sliding vertical movement of the clip member through the aforementioned range of elevations, and an outer depending leg for outwardly overlying the lower-course panel when the inner leg is thus inserted, the outer leg having a free lower end shaped and disposed to interlock with the second locking means of the interposed panel. A plurality of such spring clip members, spaced apart horizontally along the top margin of the lower-course panel, are ordinarily or preferably employed to constitute the interlocking means.

As a further particular feature of the invention, the retaining means comprises at least one spring clip element having a vertical leg fixedly mountable on the wall, and an outwardly and downwardly projecting leg with an upper engaging portion for engaging and retaining the first locking means of the interposed panel to prevent downward and outward movement thereof relative to the wall; and the clip means is formed integrally with the retaining means, comprising a lower engaging portion of the projecting leg formed to engage the second locking means of the upper-course panel for preventing outward movement thereof relative to the wall. A portion of the vertical leg of the clip element, spaced above the upper engaging portion of the projecting leg, is formed to interferingly engage the top margin of the interposed panel when the first locking means thereof engages the upper engaging portion of the projecting leg, for preventing upward movement of the interposed panel above the aforementioned location. Again, preferably, a plurality of these clip elements are used, spaced horizontally along the wall.

In the systems and devices of the present invention, the elevation of the first locking means of the interposed panel above the second locking means of the upper-course panel is invariant, and the floating vertical position of the interlocking means accommodates a substantial range of gaps, i.e. enabling the second locking means of the interposed panels to be secured properly to the wall without requiring close tolerances in the spacing between the upper and lower-course panels so long as that spacing is somewhat less than the height of the interposed panel. The restraint of the interposed panel against upward movement by the retaining means insures satisfactorily fixed mounting of the interposed panel notwithstanding that the interlocking means is itself floatingly mounted on (vertically movable relative to) the lower-course panel.

Again stated with reference to prefabricated walls, a particular advantage of the present systems and methods is that the retaining means as well as the clip means can be mounted by the manufacturer of the wall sections, and since the interlocking means are simply loosely inserted behind the lower-course panels, there is no need for precisely positioning and/or fastening any elements of the mounting devices by the assembler in the field. Embodiments of the invention wherein the clip means are integral with the retaining means afford the further advantage that they can be installed in a single operation.

Further features and advantages of the invention will be apparent from the detailed description hereinbelow set forth, together with the accompanying drawings.

BRIEF DESCRIPTION OF THE DRAWINGS

FIG. 1 is a front elevational view of a siding system incorporating an illustrative embodiment of the system of the invention;

FIG. 2 is an enlarged perspective view of the clip and retaining means of the embodiment of FIG. 1;

FIG. 3 is a similarly enlarged perspective view of the interlocking means of the FIG. 1 embodiment.

DETAILED DESCRIPTION

Figure 4:
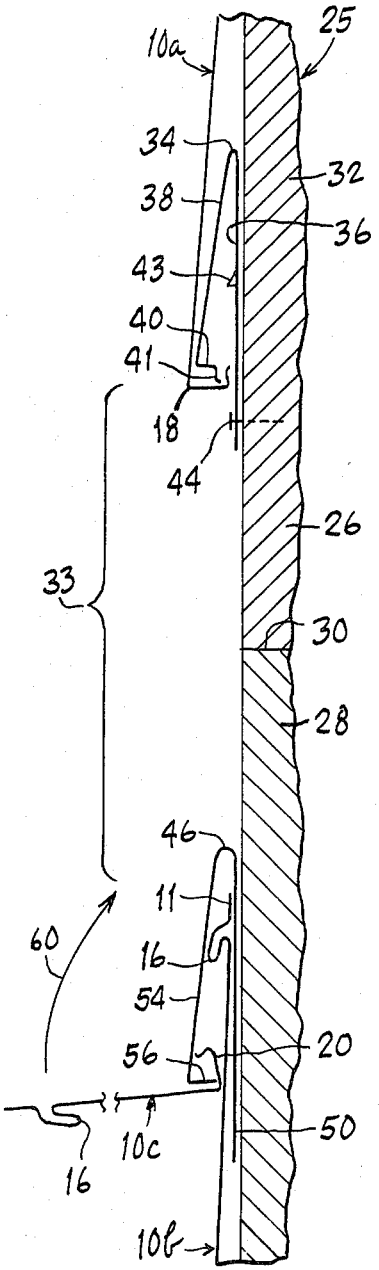
FIGS. 4, 5 and 6 are enlarged side elevational sectional views illustrating successive steps or stages in the installation of a panel using the embodiment of FIG. 1.

Referring to the drawings, the invention is illustrated and will be described as embodied in systems and methods for use with horizontally elongated, roll-formed sheet aluminum siding panels 10 of a generally conventional type such as are commonly mounted in successive parallel overlapping courses, one above another, on an exterior building wall, to clad the wall protectively and to simulate the appearance of wooden clapboards. Each of these panels 10 has a top margin 11 including a nailing flange portion 12 perforated at horizontally spaced intervals by nail holes 14 and an outwardly and downwardly projecting head or lip 16 formed immediately below the nailing flange. In addition, each panel 10 has a bottom margin 18 formed into an inwardly projecting, upwardly opening channel flange 20. The lip 16 and channel flange 20, both of which extend along at least substantially the full horizontal length of the panel, respectively constitute complementary first and second locking means for interlocking vertically adjacent panel courses when the panels are mounted in conventional manner on a wall.

In such conventional mounting of the panels, each course of panels is secured to a wall by driving nails 22 into the wall through holes 14 of the nailing flanges. The panels of the next higher course are then so positioned on the wall that their bottom margins overlap the top margins of the already-nailed course of panels, with the lips 16 of the latter panels received in the channel flanges 20 of the higher-course panels, and the top margins of the higher-course panels are nailed in turn to the wall, this operation being repeated for successively higher courses until the wall is fully covered by the panels. Each panel in the thus-mounted array is fixed to the wall at its top margin by the nails driven therethrough, and at its bottom margin by the interlocking engagement of its second locking means or channel flange 20 with the first locking means or lip 16 of a panel or panels of the next lower course; the major surface 24 of each panel slopes downwardly and outwardly from the lip to the bottom margin of the panel. Typical or exemplary dimensions of the panels are 8 inches in panel height and up to 12 feet in horizontal length, all the panels of a given array being ordinarily essentially identical in height.

To illustrate a particular environment of use for which the advantages of the invention are important, there is shown (in FIGS. 1, 4–6, 7 and 8) a vertical exterior building wall 25 comprising upper and lower prefabricated wall sections respectively designated 26 and 28 disposed one above another, and fixedly secured together at a joint 30, with their outer surfaces in a common plane. Each wall section is a factory-assembled frame of studs and exterior wooden sheathing 32. Mounted on the sheathing of each section is a partial array of the panels 10; these panels are installed by the manufacturer of the prefabricated sections in such manner that when the sections are joined together at a building site, the panels mounted on the upper section 26 are parallel to the panels on the lower section 28 but a vertical space or gap 33 is left between the top course of panels on the lower section and the bottom course of panels on the upper section. The bottom course of panels on the upper wall section will hereinafter be designated the upper course 10*a*, and the top course of panels on the lower wall section will be designated the lower course 10*b*.

The existence of a gap 33 in the panel array at the joint 30 is dictated by the fact that the height of the lower wall section is usually not an integral multiple of the height of one panel, and also by the practical impossibility of interlocking pre-installed upper and lower courses of panels at the joint 30 when the wall sections are joined together, i.e. even if the panels of those courses were positioned to meet at the joint. For both protective and aesthetic reasons, this gap 33 must be bridged (thereby to cover the joint 30) at the building site after the wall sections are assembled. Ordinarily, however, it is not possible to bridge the gap by simply simultaneously interlocking the lip 16 and channel flange 20 of an interposed course of the panels 10 with the channel flange and lip, respectively, of the upper and lower course panels, because inaccuracies of stud wall construction (e.g. owing to variation of stud sizes or placement of components) prevent reliable provision of a gap height within the close tolerances required for such simultaneous interlocking.

The present invention, in its embodiments now to be described, provides systems and methods for mounting an interposed course 10*c* of the panels 10 between the vertically spaced, already-installed upper and lower courses 10*a* and 10*b*, for example in a prefabricated wall construction of the type referred to above.

For the practice of the invention, the pre-installed upper course 10*a* and lower course 10*b* of panels are so positioned on their respective wall sections that, when the wall sections are secured together, the height of the gap 33 (between the channel flanges 20 of the upper-course panels and the lips 16 of the lower-course panels) is less than the height (between lip 16 and channel flange 20) of the panels of the course 10*c* which is to be interposed in the gap. Within this limit, however, the present invention accommodates substantial variation in gap height, such as may be caused by the aforementioned variations in stud wall construction. Thus, for example, with an interposed panel height of 8 inches, the height of the gap 33 may be anywhere from about 7 to about $7\frac{3}{4}$ inches. It is relatively easy for the prefabricated wall manufacturer to assure that the gap height will be within such a range.

The system of the invention in the specific embodiment shown includes integrally formed clip means and retainer means comprising a plurality of clip elements 34 fixedly mountable on the upper wall section 26 for interlocking with the channel flanges 20 of the panels of the upper course 10*a* to secure the bottom margin of the upper-course panels to the wall section 26 and for positively restraining the first locking means of an interposed panel 10*c* against upward or downward movement relative to the wall while fixedly securing the top margin of the interposed panel to the wall. As best seen in FIG. 2, each of these clip elements 34 is a unitary strip of relatively heavy gauge, stiffly resilient sheet metal bent (transversely of its long dimension) at a central locality to provide a first, vertical leg 36 and a second leg 38 extending outwardly and downwardly from the upper extremity of leg 36 at an acute angle thereto; the second leg has a free lower end bent first inwardly (toward the first leg 36) to provide an upper engaging portion in the form of a horizontal ledge 40, and then downwardly and inwardly again to provide a lower engaging portion or locking flange 41. The first leg 36 is substantially longer than the second leg 38, so that a portion 36*a* of leg 36 is exposed below leg 38; at least one nail hole 42 is provided in this exposed portion 36*a*. In addition, an outwardly protruding step tab 43 is formed in the vertical leg 36 at such an elevation above the horizontal ledge 40 that, when the first locking means or lip 16 of an interposed panel rests on the ledge 40, the top margin 11 of the same panel is interferingly engaged by the tab 43; the ledge and tab thereby cooperatively prevent movement of the lip and top margin of the panel 10*c*, relative to the wall, either upwardly or downwardly from the location at which the panel lip and top margin are thus engaged. It will be understood that the retaining means of the invention is embodied in portions of the clip element 34 including the ledge 40 and tab 43, while the clip means is embodied in portions of the clip element including the locking flange 41.

In use, the clip elements 34 are mounted (by nails 44 driven through the holes 42) on the outer surface of the sheathing 32 of the upper wall section 26, adjacent the bottom margin of the wall section 26, in horizontally spaced relation to each other with their ledges 40 horizontally aligned. The locking flanges 41 are dimensioned to be received in, and to interlock with, the channel flanges 20 of the upper-course panels 10*a* (see FIG. 4), thereby to secure the bottom margins of the upper-course panels to the wall section, with the lower portions of the latter panels overlying and concealing the legs 38.

Figure 6:
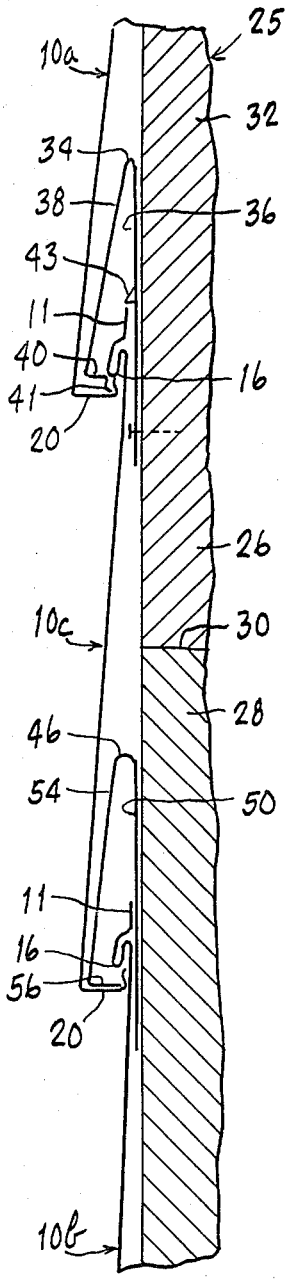

As hereinafter further explained, the ledge 40 of the leg 38 of each clip element 34 is positioned, in relation to the locking flange 11, to support the first locking means or lip 16 of an interposed panel 10*c* in the space between legs 36 and 38 at a fixed level above the elevation at which the lip 16 of that panel 10*c* would interlock with the channel flange 20 of an upper-course panel 10*a*, i.e. assuming the latter channel flange to be interlocked with the locking flange 41 of the clip element, while the tab 43 prevents upward movement of the panel top margin above the last-mentioned level (FIG. 6). The clip element thereby fixedly secures the top margin of the interposed panel 10*c* to the wall section 26, in a position at which the bottom margin of the upper-course panel interlocked with the flange 41 outwardly overlies and conceals the top margin and lip of the interposed panel.

The illustrated embodiment of the invention also includes interlocking means comprising a plurality of clip members 46 slidably or floatably mountable on the lower course 10*b* of panels on the wall section 28 and each having a portion for engaging the second locking means or channel flange 20 of an interposed panel 10*c* so as to secure the bottom margin of the interposed panel against outward movement relative to the wall. As shown in FIG. 3, each of the clip members 46 is a strip of relatively heavy gauge, stiffly resilient sheet metal, having a long, flat inner depending vertical leg 50 and a second depending leg 54 projecting downwardly and outwardly from the upper extremity of the leg 50; the leg 54 has a free lower end bent inwardly to form a locking flange 56 dimensioned to be received in and to interlock with the channel flange 20 of an interposed panel 10*c* with the lower portion of the latter panel overlying and concealing the leg 54 (FIG. 5).

The clip members 46 are mounted on the lower course of panels, in horizontally spaced relation to each other, by simply inserting their inner vertical legs 50 downwardly between the top margins of the lower-course panels 10*b* of the wall section 28 after the latter panels are fastened to the wall, the clip members 46 being positioned intermediate the horizontally spaced nails 22 that hold the panel top margins on the wall, and their outer legs 54 outwardly overlying the upper portions of the panels 10*b* to a level below the elevation of the first locking means of those panels. As thus mounted, the clip members are slidably movable (relative to the panels 10*b*) upwardly and downwardly through a substantial range of vertical positions at which they are retained by the top margins of the panels 10*b* against outward movement relative to the wall.

Figure 5:
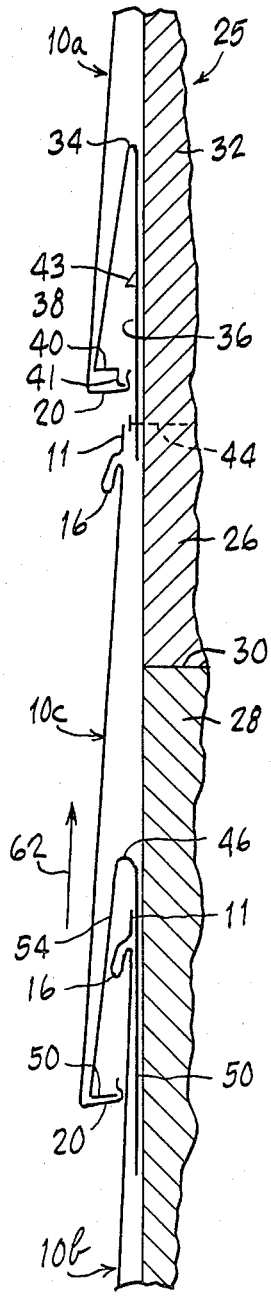

The installation of the above-described system may now be readily explained with particular reference to FIGS. 4–6. It will be understood that the panels 10 (other than the interposed course 10*c*) are installed on the prefabricated wall sections 26 and 28 by the manufacturer of the wall sections, i.e. at the factory; in what may be a generally conventional manner except that the bottom margins of the panels of the upper course 10*a* are secured to the wall section 26 by nailing the clip elements 34 to the sheathing 32 of that wall section adjacent the bottom edge thereof and interlocking the channel flanges 20 of the panels of course 10*a* with the locking flanges 41 of the clip elements. The location of the clip elements 34 on the wall section 26 is selected, with reference to the location of the lips 16 of the lower-course panels 10*b* relative to the top edge of wall section 28, so that when the prefabricated wall sections are joined together to constitute the wall 25 at a building site, the vertical height of the gap 33 between the lips 16 of the lower course 10*b* of panels and the channel flanges 20 of the upper course 10*a* of panels will be somewhat less than the panel height of the interposed course 10*c*. Once the top margins of the lower-course panels 10*b* have been fastened to the wall section 28, the clip members 46 are installed (either by the manufacturer of the wall sections, or by the assembler at the building site) at horizontally spaced locations thereon by insertion of their vertical legs 50 downwardly behind the top margins of the panels 10*b*; these clip members are not nailed in place, nor is there need to use any special care in positioning them.

After the wall sections are joined together at a building site as shown in FIG. 4, with the clip elements 34, the clip members 46, and the upper course 10*a* and lower course 10*b* of panels mounted on the assembled wall as illustrated, the installation of panels of the interposed course 10*c* is performed by the sequence of steps illustrated in FIGS. 4–6 (and also partially indicated in FIG. 1 adjacent the section lines 5—5 and 6—6). The channel flange 20 of an interposed panel 10*c* is first interlocked with the locking flanges 56 of a plurality of the clip members 46 mounted on the top margins of the lower-course panels 10*b* while the panel 10*c* is held in a substantially horizontal position as shown in FIG. 4, and the panel 10*c* is then swung upwardly (in the direction indicated by arrow 60) to the initial vertical position illustrated in FIG. 5. In this initial vertical position, the top margin 11 of the interposed panel 10*c* is below the channel flange 20 of the upper-course panels 10*a*; to provide this initial vertical position of the panel 10*c*, the legs 54 of the clip members 46 are made sufficiently long to enable the locking flanges 56 (engaged with the channel flange 20 of the panel 10*c*) to be located at a level spaced below the bottom margin of the upper-course panels 10*a* by a distance greater than the height of the interposed panel 10*c*.

Thereafter, the panel 10*c* is moved vertically upward along the wall (as indicated by arrow 62), carrying upwardly with it the clip members 46 interlocked with its channel flange 20. By this movement the top margin 11 of the panel 10*c* is inserted vertically upward behind the bottom margin of an upper-course panel 10*a*, between the legs 38 and 36 of the clip elements 34, until the lip 16 of the interposed panel passes above the horizontal ledges 40 of the elements 34. The spacing between the upper-course panel channel flange 20 (mounted on the locking flange 41) and the leg 36 of each clip element 34 in the unstressed condition of the clip element leg 38 is less than that required for such upward passage of the lip 16; but owing to the resiliency of the leg 38 and the downwardly sloping shape of the interposed panel lip, the leg 38 yields outwardly as the lip moves upwardly and then snaps back as soon as the lip passes above the ledge 40, thereby locking the lip in place (bearing against the upper surface of ledge 40) against downward movement; as this occurs, the top margin of the panel 10*c* is engaged by the tabs 43 of the clip elements 34, locking the panel 10*c* against further upward movement.

The panel 10*c* is now in the final vertical position shown in FIG. 6. Its bottom margin, though elevated above the initial vertical position of FIG. 5, still outwardly overlaps and conceals the lip 16 of the lower-course panel 10*b* (as also shown in FIG. 6), and is held against outward movement by the clip members 46, the legs 50 of which are long enough to extend downwardly behind the top margins of the lower-course panels in this final position. The locking of the top margin of the panel 10*c* against upward or downward movement from the final vertical position prevents upward or downward movement of the clip members 46 interlocked with the bottom margin of the panel 10*c*.

In this way, with a manipulatively simple upward installing movement, each panel of the interposed course 10*c* becomes fixedly secured to the wall along both its top and bottom margins, with its lip 16 positioned (and held by the clip elements 34) at a location behind the panels 10*a* and above the elevation at which the lip would interlock with the channel flange 20 of the adjacent upper-course panel 10*a*. The thus-installed panels of the interposed course 10*c* bridge the gap 33, with their top margins overlapped by the upper-course panels 10*a* and their bottom margins overlapping the lower-course panels 10*b* so as to provide, in cooperation with the previously installed panels on the wall sections 26 and 28, a continuous, overlapping array of panels extending without interruption over the joint 30 between the wall sections. Although the exposed height of the interposed panels is slightly less than that of the other panels of the array, the difference in exposed heights is not objectionably noticeable; yet (because the clip members 46 are positionable throughout a range of elevations relative to the lower-course panels) the invention accommodates a practicably broad range in spacing between the upper and lower courses 10*a* and 10*b* resulting from variations in stud wall construction. The lips 16 of the interposed panels 10*c* are concealed behind the upper-course panels 10*a*, and the upper-course panels and interposed panels together fully conceal the clip elements 34 and clip members 46 as well as the lips 16 of the lower-course panels 10*b*.

It is commonly preferable to position the clip elements 34 at the locations of vertical studs of the wall sections, to provide a secure footing for the nails that fasten them to the wall. Such positional coincidence is not essential, however; for example, if the sheathing 32 is sufficiently heavy to obviate nailing into the studs, the clip elements 34 could be positioned at locations intermediate the studs. In addition, the separate clip elements 34 could be replaced by a continuous metal strip of like profile, as indeed could the clip members 46; but to save metal, use of separate small clips is ordinarily preferred.

As already described, each clip element 34 is, in effect, a spring clip, its outer leg 38 having a free lower extremity and being resiliently displaceable to enable upward insertion of a lip 16 of a panel 10*c* and to lock the lip in place against downward movement after the lip is inserted, as well as to hold the channel flange 20 of an upper-course panel 10*a* with no undesired gap between that channel flange and the adjacent surface portion of an interposed panel 10*c*. Similarly, each of the clip members 34 is a spring clip; the spacing between its locking flange 56 and vertical leg 50 in the unstressed condition of the clips may be less than that required for insertion of the channel flange 20 of a panel 10*c* therebetween, but the clip leg 54 (which also has a free lower extremity) yields outwardly to permit such insertion and then, being resilient, returns so that there is no undesired gap between the channel flange of a panel 10*c* and the adjacent surface portions of a panel 10*b*.

It is to be understood that this invention is not limited to the features and embodiments hereinabove specifically set forth, but may be carried out in other ways without departure from its spirit.

We claim:

1. A system for mounting, on a wall, a horizontally elongated sliding panel in interposed relation to vertically spaced upper and lower courses of like panels already secured to the wall, said siding panels being of a type that are disposed one above another on a wall in parallel, overlapping array, each of said panels having a top margin along which it is attached to the wall, a bottom margin, and complementary first and second locking means respectively adjacent said top and bottom margins for interlocking vertically adjacent overlapping panels by engagement of the first locking means of one overlapped panel with the second locking means of an overlapping panel immediately above it in the array, the vertical distance between the second locking means of said upper course and the first locking means of said lower course being less than the vertical distance between the first and second locking means of said interposed panel, said system comprising (a) clip means fixedly mountable on the wall for interlocking with the second locking means of a panel of said upper course to secure the bottom margin of the upper-course panel to the wall;

(b) retaining means securable to the wall and having a portion for engaging the first locking means of the interposed panel, at a location behind the last-mentioned upper-course panel and above the elevation at which the first locking means of the interposed panel would interlockingly engage the second locking means of said last-mentioned upper-course panel, to hold the first locking means of the interposed panel against downward movement below said location and to secure the top margin of the interposed panel to the wall, with said clip means and said retaining means both concealed behind the upper-course and interposed panels, said clip means being shaped and dimensioned to permit the top margin of the interposed panel to be inserted upwardly behind the last-mentioned upper-course panel sufficiently to position the first locking means of the interposed panel at said location; and (c) means for interlocking with the second locking means of the interposed panel, when the first locking means engages said portion of said retaining means at said location, to secure the bottom margin of the interposed panel to the wall;

wherein the improvement comprises:

(d) said retaining means including means for positively restraining the first locking means of the interposed panel against upward movement above said location; and (e) said interlocking means comprising means, mountable on the top margin of a panel of the lower course so as to be selectively positionable throughout a range of elevations relative thereto, for interlocking with the second locking means of the interposed panel outwardly of the lower-course panel at a level below that at which the second locking means of the interposed panel would interlock with the first locking means of the lower-course panel.

2. A system as defined in claim 1, wherein said interlocking means comprises at least one spring clip member having an inner depending leg insertable between the top margin of the lower-course panel and the wall for holding the clip member against outward movement while permitting sliding vertical movement of the clip member through the aforementioned range of elevations, and an outer depending leg for outwardly overlying the lower-course panel when the inner leg is inserted as aforesaid, said outer leg having a free lower end shaped and disposed to interlock with the second locking means of the interposed panel.

3. A system as defined in claim 2, wherein said interlocking means comprises a plurality of said clip members, mountable in horizontally spaced relation to each other along the top margin of the lower-course panel.

4. A system as defined in claim 1, 2, or 3, wherein said retaining means comprises at least one spring clip element having a leg fixedly mountable on the wall, and a second leg projecting outwardly and downwardly therefrom with an engaging portion for engaging and retaining the first locking means of the interposed panel to prevent downward and outward movement of the first locking means of the interposed panel relative to the wall, said vertical leg having a portion, spaced above said engaging portion of said projecting leg, formed to interferingly engage the top margin of the interposed panel when the first locking means thereof engages the engaging portion of the projecting leg, for preventing upward movement of the interposed panel above said location.

5. A system as defined in claim 4, wherein said clip means is formed integrally with said retaining means and comprises a second engaging portion of said projecting leg of said clip element, disposed below the first-mentioned engaging portion, and formed to engage the second locking means of the upper-course panel for preventing outward and upward movement thereof relative to the wall.

6. A system as defined in claim 5, wherein said retaining means comprises a plurality of said clip elements, mountable in horizontally spaced relation to each other along said wall.

7. A siding panel assembly mounted on a wall and comprising, in combination, (a) a plurality of courses of horizontally elongated siding panels secured to the wall, said siding panels being disposed one above another on the wall in parallel, overlapping array, each of said panels having a top margin along which it is attached to the wall, a bottom margin, and complementary first and second locking means respectively adjacent said top and bottom margins for interlocking vertically adjacent overlapping panels by engagement of the first locking means of one overlapped panel with the second locking means of an overlapping panel immediately above it in the array, said assembly including vertically spaced upper and lower courses of the panels and at least one other panel interposed between the upper and lower courses, the vertical distance between the second locking means of said upper course and the first locking means of said lower course being less than the vertical distance between the first and second locking means of said interposed panel;

(b) clip means fixedly mounted on the wall and interlocked with the second locking means of said interposed panel;

(c) retaining means secured to the wall and having a portion engaging the first locking means of the interposed panel, at a location behind the last-mentioned upper-course panel and above the elevation at which the first locking means of the interposed panel would interlockingly engage the second locking means of said last-mentioned upper-course panel, for holding the first locking means of the interposed panel against downward movement below said location and to secure the top margin of the interposed panel to the wall, with said clip means and said retaining means both concealed behind the upper-course and interposed panels, said clip means being shaped and dimensioned to permit the top margin of the interposed panel to be inserted upwardly behind the last-mentioned upper-course panel at least sufficiently to position the first locking means of the interposed panel at said location; and (d) means interlocking with the second locking means of the interposed panel for securing the bottom margin of the interposed panel to the wall;

wherein the improvement comprises:

(e) said retaining means including means for positively restraining the first locking means of the interposed panel against upward movement above said location; and (f) said interlocking means comprising means, mounted on the top margin of a panel of the lower course so as to be selectively positionable throughout a range of elevations relative thereto, for interlocking with the second locking means of the interposed panel outwardly of the lower-course panel at a level below that at which the second locking means of the interposed panel would interlock with the first locking means of the lower-course panel.

8. An assembly as defined in claim 7, wherein said clip means and said retaining means are formed integrally.

* * * * *